US005178486A

United States Patent [19]

Perrin et al.

[11] Patent Number: 5,178,486

[45] Date of Patent: Jan. 12, 1993

[54] DEVICE FOR SPREADING A FLUID SUBSTANCE, AND MACHINE PERMITTING THE SIMULTANEOUS APPLICATION OF THIS SUBSTANCE AND OF THE SURFACING OF A HIGHWAY

[75] Inventors: Michel Perrin, Noisy-le-Grand; Jean-Pierre Reymonet, Le Chesnay; Clément Beatrix, St. Christo en Jarez; Pierre Defontaine, Nantes; Philippe Brissonneau, Rousset, all of France

[73] Assignee: Colas S.A., Boulogne-Billancourt Cedex, France

[21] Appl. No.: 718,266

[22] Filed: Jun. 20, 1991

[30] Foreign Application Priority Data

Jun. 21, 1990 [FR] France ..... 90 07807

[51] Int. Cl.[5] ..... E01C 19/12; E01C 19/18

[52] U.S. Cl. ..... 404/101; 404/108

[58] Field of Search ..... 404/83, 101, 104, 108; 239/128

[56] References Cited

U.S. PATENT DOCUMENTS 4,018,540 4/1977 Jackson, Sr. ..... 404/95
4,688,964 8/1987 Cox ..... 404/111 X
5,069,578 12/1991 Bense et al. ..... 404/75

FOREIGN PATENT DOCUMENTS 0292337 11/1988 European Pat. Off. .
1041511 9/1966 United Kingdom .

*Primary Examiner*—Thuy M. Bui
*Assistant Examiner*—Nancy P. Connolly
*Attorney, Agent, or Firm*—Sandler, Greenblum & Bernstein

[57] ABSTRACT

A device for spreading a fluid substance or the like, in particular a bonding emulsion for bituminous coated materials, over the surface of a road (C), comprising, on a movable machine (1), at least one spreading bar (18) along which the spreading is effected at least partially, said bar being associated with an emulsion-supply circuit, wherein a bar comprises at least one chamber (19) comprising at least one aperture on its part intended to be opposite the road (C), said chamber (19) being associated with supply and nebulization means (27, 28, 29) which make it possible to supply the inside of said chamber (19) with nebulized-emulsion, and with means intended to promote the deposition of the nebulized emulsion on the road (C) through said aperture.

31 Claims, 2 Drawing Sheets

DEVICE FOR SPREADING A FLUID SUBSTANCE, AND MACHINE PERMITTING THE SIMULTANEOUS APPLICATION OF THIS SUBSTANCE AND OF THE SURFACING OF A HIGHWAY

FIELD OF THE INVENTION

The present invention relates to a device for spreading a bonding emulsion for bituminous coated materials over the surface of a road, and to a highway-construction machine of the finisher type comprising such a device.

DESCRIPTION OF THE PRIOR ART

It is known that the bonding of the various layers of materials which make up a highway (cement-bound sand and gravel, bituminous base course, bituminous coated materials) is effected by spreading a bonding emulsion before the application of the top layer. For a long time, this layer of emulsion has been deposited before the passage of the finisher which is intended to place the bituminous coated materials, by a machine comprising a tank and a spreading bar.

However, it has recently been found, as was explained in the document EP-A-292,337, that this method had numerous disadvantages:

- highway spreaders, which had a large overall size and poor manoeuvrability, were poorly suited to urban construction sites,
- furthermore, the finisher was provided with coated materials by trucks which, when they drove over the bonding layer not covered with bitumen, contributed, together with the caterpillar tracks of the finisher, toward the partial removal of said bonding layer when their wheels passed over it, at precisely those parts of the highway which are subsequently the most highly stressed by the loads engendered by the passage of heavy trucks,
- in addition, these spreaders gave rise to dirt which is both annoying and dangerous for users using the adjacent highways.

Now, poor bonding systematically causes a weakness in the structure of the highway and damage as a result of more rapid fatigue.

It has also been proposed, in particular in the above-mentioned document EP-A-292,337, to deposit the bonding layer just before the application of the coated materials by the finisher. The device proposed in EP-A-292,337 associates the finisher with an independent frame which is mounted on running means and moves in front of said finisher at the same, speed as the latter, said frame serving to spread the bonding layer.

Further, this device in no way stops the caterpillar tracks of the finisher from traveling over the bonding layer, and precisely at those parts of said bonding layer which are subsequently the most highly stressed. Furthermore and above all, the multiple-orifice spreading bars used on conventional binder spreaders prove, in practice, to be totally unsuited to this novel device: the spreading over the ground of the normal quantities of binder—which quantities are relatively small (300 g per $m^2$ to 1.2 kg per $m^2$)—is effected by the displacement of the spreading bar at the same speed as the finisher, in other words at a much slower speed (3 m/min to 6 m/min) than that of the conventional spreaders (30 m/min to 100 m/min); this assembly must generate a low binder throughput and consequently the orifices of the conventional spreading nozzles are no longer suitable and must have a very small diameter, thus tending to become plugged by virtue of the viscosity of the binders used.

GENERAL DESCRIPTION OF THE INVENTION

The object of the present invention is therefore to overcome these various disadvantages and to provide a device having a spreading bar which avoids jets with an orifice of a very small diameter which is incompatible with the viscosity of the binders currently used. It proposes, in particular, a spreading device in which the nozzles are replaced by a chamber which contains nebulized emulsion inside it, said chamber being equipped opposite the road with a large aperture which makes it possible to deposit said nebulized emulsion on said road.

Moreover, the device proposed by the invention also has the advantage of having a sufficiently small overall size to enable it to be placed at the rear of the finisher, behind the caterpillar tracks of the latter, between said caterpillar tracks and the means for spreading the bituminous coated materials over the road.

The subject of the present invention is therefore a device for spreading a bonding emulsion for bituminous coated materials over the surface of a road, which comprises, on a movable machine, at least one spreading bar along which the spreading is effected at least partially, said bar being associated with an emulsion-supply circuit, wherein a boom comprises at least one chamber comprising at least one aperture on its part intended to be opposite the road, said chamber being associated with supply and nebulization means which make it possible to supply the inside of said chamber with a nebulized emulsion, and with means intended to promote the deposition of the nebulized emulsion toward the road through said aperture.

The means intended to promote the deposition of the emulsion on the road (C) comprise, in one advantageous embodiment, a coating of the walls which define said chamber with a material having a low, or substantially no adhesion to the bonding emulsion. A material constituting said coating can, for example, be of the polytetrafluoroethylene type.

In another embodiment, when the bonding emulsion is ionic or electrically charged, said chamber is insulated electrically from the mass of the movable machine, the walls of said chamber being charged electrically with a polarity identical to that of the emulsion. The walls of said chamber can be made at least partially from metal, in particular from non-oxidizing metal. The walls of the chamber can be positively charged, the emulsion being a cationic emulsion.

The length of the chamber can preferably be adjusted.

The chamber can comprise, in particular, a main part which is associated with means enabling said main part to be extended laterally. The chamber can comprise a main part extending substantially over a width of the movable machine and associated at each of its ends with lateral-extension means. A chamber is delimited, wholly or partly, by the walls of a box which is equipped with an aperture on its part opposite the road. In particular, the main part of the chamber is delimited by a central box which extends substantially over a width of the movable machine and which is associated at each of its ends with a lateral box connected leaktightly by fitting together with said central box, the length of the relative fitting-together of the central box and of a lateral box being adjustable. The length of the chamber can, for example, be adjusted via hydraulic jacks.

Furthermore, the supply and nebulization means preferably comprise a pneumatic atomizer associated with an emulsion inlet and a pressurized-gas inlet. The pressurized gas can be compressed air. These supply and nebulization means can be distributed toward each of the ends of the chamber and/or toward its mid part.

The aperture of the chamber is advantageously surrounded at least partially by flexible skirts which extend, in the operating position of the bar, from said aperture substantially to the surface of the road. The chamber can also be surrounded at least partially by a curtain or curtains of pulsed air. The chamber can be associated with a nozzle for supplying gas or hot air.

The bar is preferably associated with means mounted on the movable machine and enabling said bar to be placed in the operating position or to be raised with respect to the road. Said means for placing in the operating position or for raising can be hydraulic jacks.

Another subject of the invention is a highway-construction machine of the finisher type, comprising, on a frame mounted on displacement means, means for spreading bituminous coated materials and means for supplying said spreading means, which comprises a device for spreading a bonding emulsion for said coated materials over the surface of a road of the above-described type. The device for spreading a bonding emulsion is advantageously arranged at the rear of the frame with respect to the direction of displacement of the machine during the spreading of the coated materials. The device for spreading a bonding emulsion can be arranged between the displacement means of said machine and the means for spreading bituminous coated materials. The device for spreading a bonding emulsion can, for example, be arranged beneath the part of the supply means which is situated at the rear of the frame, with respect to the direction of displacement of the machine during spreading of the coated materials. When the supply means comprise a supply belt which enables the materials to be conveyed from a zone toward the front part of the machine to a zone toward its rear part, said supply belt can be substantially raised and/or inclined at its rear part just above the means for spreading a bonding emulsion.

Preferably, when the machine comprises a control cabin, it also comprises an emulsion tank mounted on the control cabin. An interchangeable tank can be mounted on height-adjustable hydraulic jacks.

Furthermore, such a machine can comprise an emulsion-metering unit which comprises a metering pump supplying the nebulization means; it can comprise a set of control means which make it possible for the flow rate and the stopping of the binder supply to be made dependent upon the displacement and the speed of the machine; this spreading device can be capable of being disconnected rapidly from the frame of the machine.

The machine can also comprise a heat-insulated emulsion tank.

BRIEF DESCRIPTION OF THE DRAWINGS

The following description of the invention is given purely as a guide and with no limitation being implied. It should be read in conjunction with the attached drawings.

In these drawings.

Lastly.

DESCRIPTION OF PREFERRED EMBODIMENTS

Figure 1:
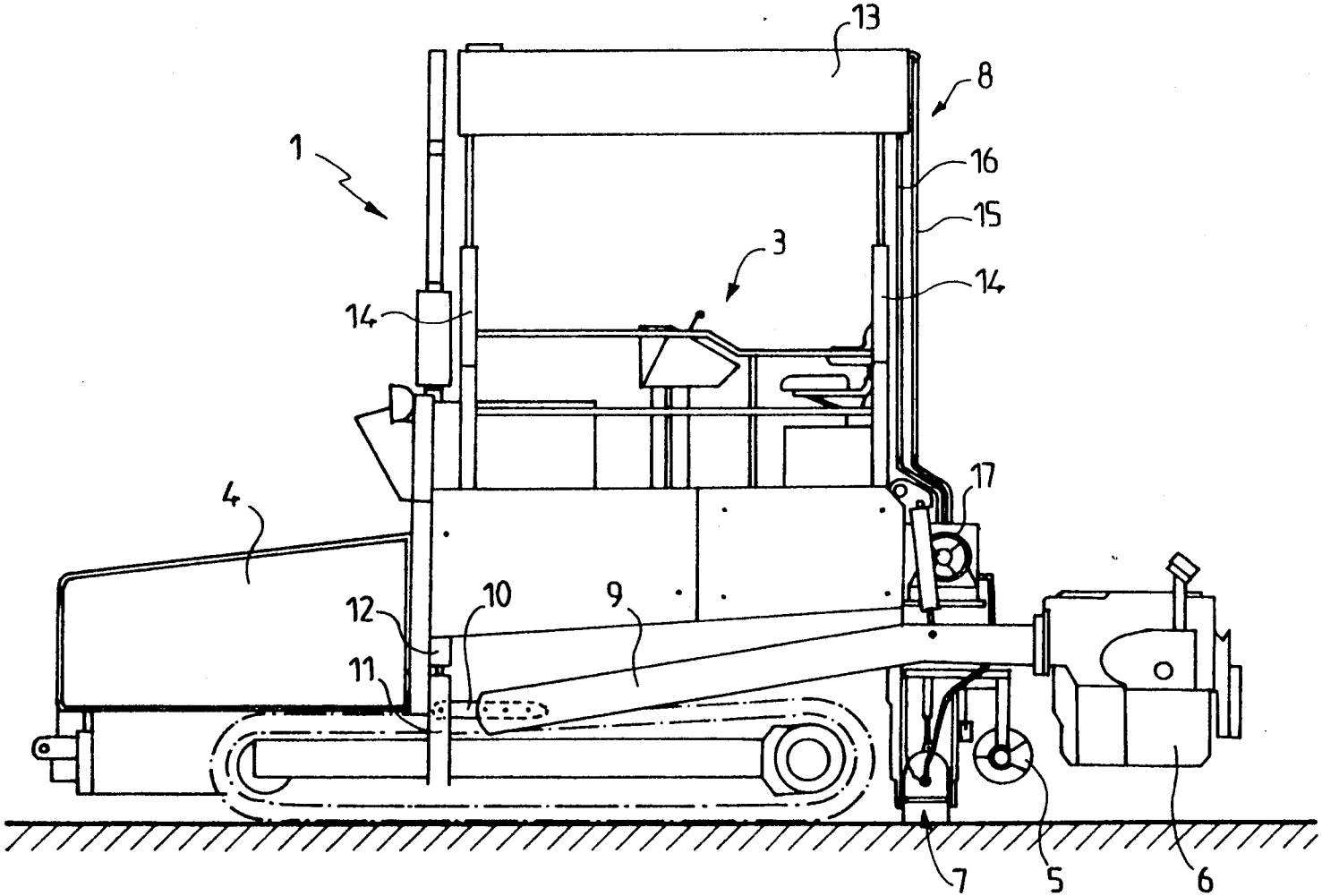
FIG. 1 is a side view of a machine of the finisher type according to the invention, in other words equipped with a spreading device according to an embodiment of the invention.

Referring more particularly to FIG. 1, it can be seen that a machine of the finisher type according to the invention, referenced as a whole by 1, is mounted on caterpillar tracks 2 and essentially comprises a control cabin 3, a hopper 4 for receiving bituminous coated materials, said hopper 4 being arranged at the front of the finisher, conventional means 5 for spreading the bituminous coated materials which consist, in particular, of a distributor screw and which are arranged at the rear of the finisher 1, a table 6 for smoothing the deposited layers of coated materials, and a device 7 for spreading a binder emulsion, associated with an emulsion-supply circuit referenced as a whole by 8.

The hot mix is transferred in a conventional manner from the hopper 4 to the means 5 for spreading the coated materials via a transfer belt (not shown) arranged on the finisher 1 between the cabin 3 and the part of said finisher 1 which carries the caterpillar tracks 2. This belt is slightly raised at its rear part above the spreading means 7. The smoothing table 6 is mounted at the rear of the finisher 1, beyond the means for spreading the coated materials 5, on two angled arms 9 which extend on each side of the machine, substantially from the mid part of the caterpillar tracks to a point beyond the spreading means 5. These two arms 9 are articulated at their end opposite the smoothing table 6 on tie bars 10 which are mounted at the level of the caterpillar tracks 2, the inclination of said arms 9 with respect to the plane of the ground determining the height of the smoothing table 6 and being adjusted via jacks 11 which each extend between a fastening point on the tie bar 10 and a fastening point 12 on the side of the frame of the tractor in the extension of the floor of the cabin 3, at the rear of the latter.

The supply circuit 8 essentially comprises an emulsion tank 13, with a capacity greater than 2500 liters. This tank 13 is arranged above the cabin 3 and extends substantially over the entire length of the latter. It is mounted on four hydraulic lifting jacks 14 which extend perpendicularly to the floor of the cabin 3 in the vicinity of each of the four ends of this floor. These jacks 14 make it possible to adjust, as desired, the height of the tank 13 on the finisher 1, the said tank 13 having, for example, an upper use position and a lower stored position facilitating the transportation of the finisher 1. This tank 13 is a cartridge container which can be replaced during operation, if necessary, the walls of this tank 13 comprising orifices, equipped with a valve, which are intended to interact with the male ends of pipes 15 and 16 which are supply and return pipes connecting the tank 13 to a unit 17 for metering the binder emulsion which provides flow rate and pressure. The tank 13 is furthermore a heat-insulated tank which can be heated electrically.

Figure 2:
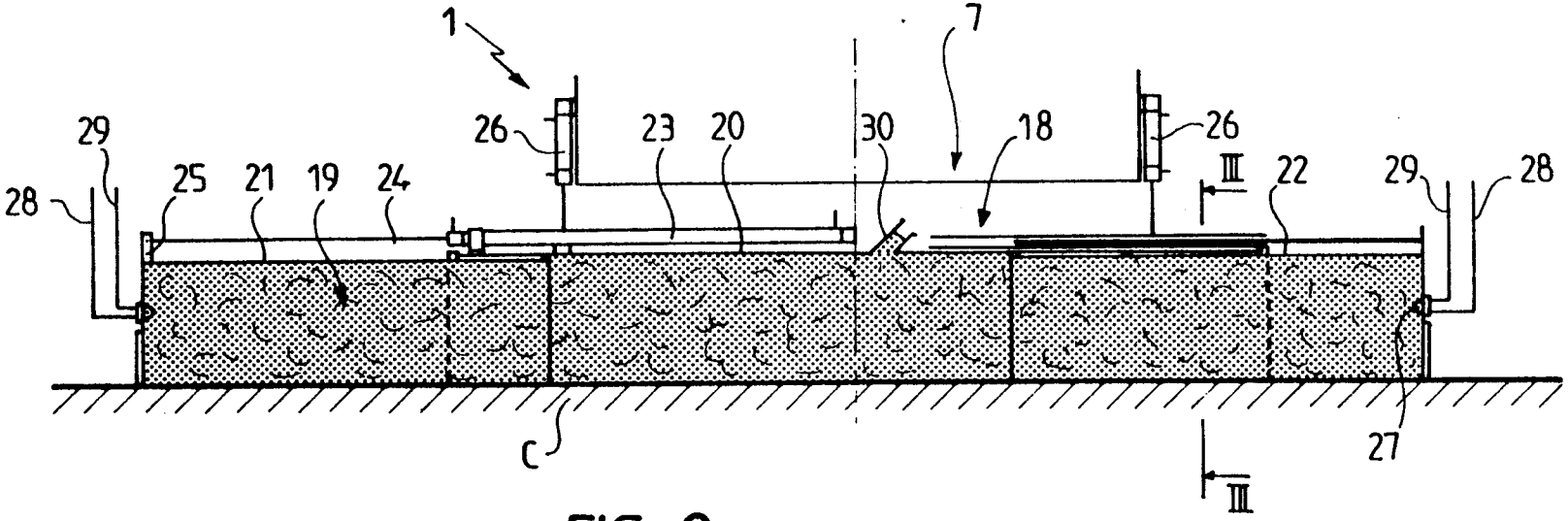
FIG. 2 is a diagrammatic view in longitudinal section of the spreading device in FIG. 1.
Figure 4:
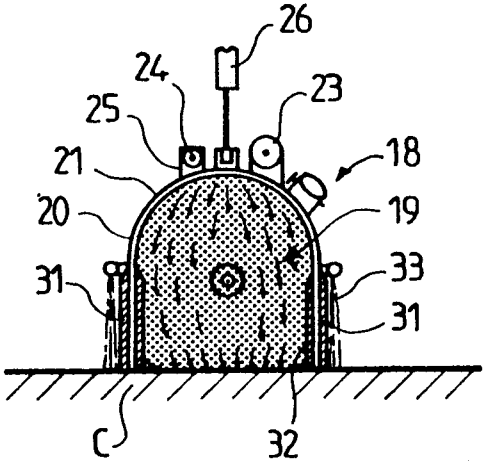
FIG. 4 is a diagrammatic sectional view, similar to that in FIG. 3, of a second possible alternative of the device in FIG. 2.
Figure 3:
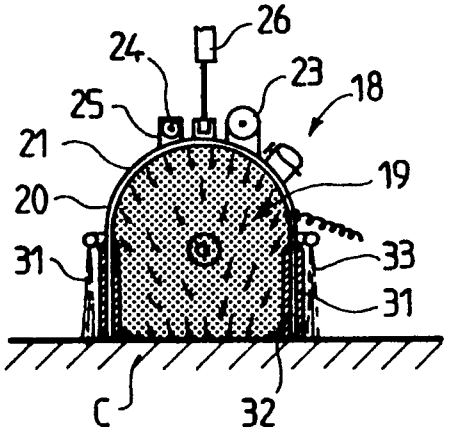
FIG. 3 is a diagrammatic view in section along the line A—A in FIG. 2, of a first possible alternative of the device in FIG. 2.
Figure 1:
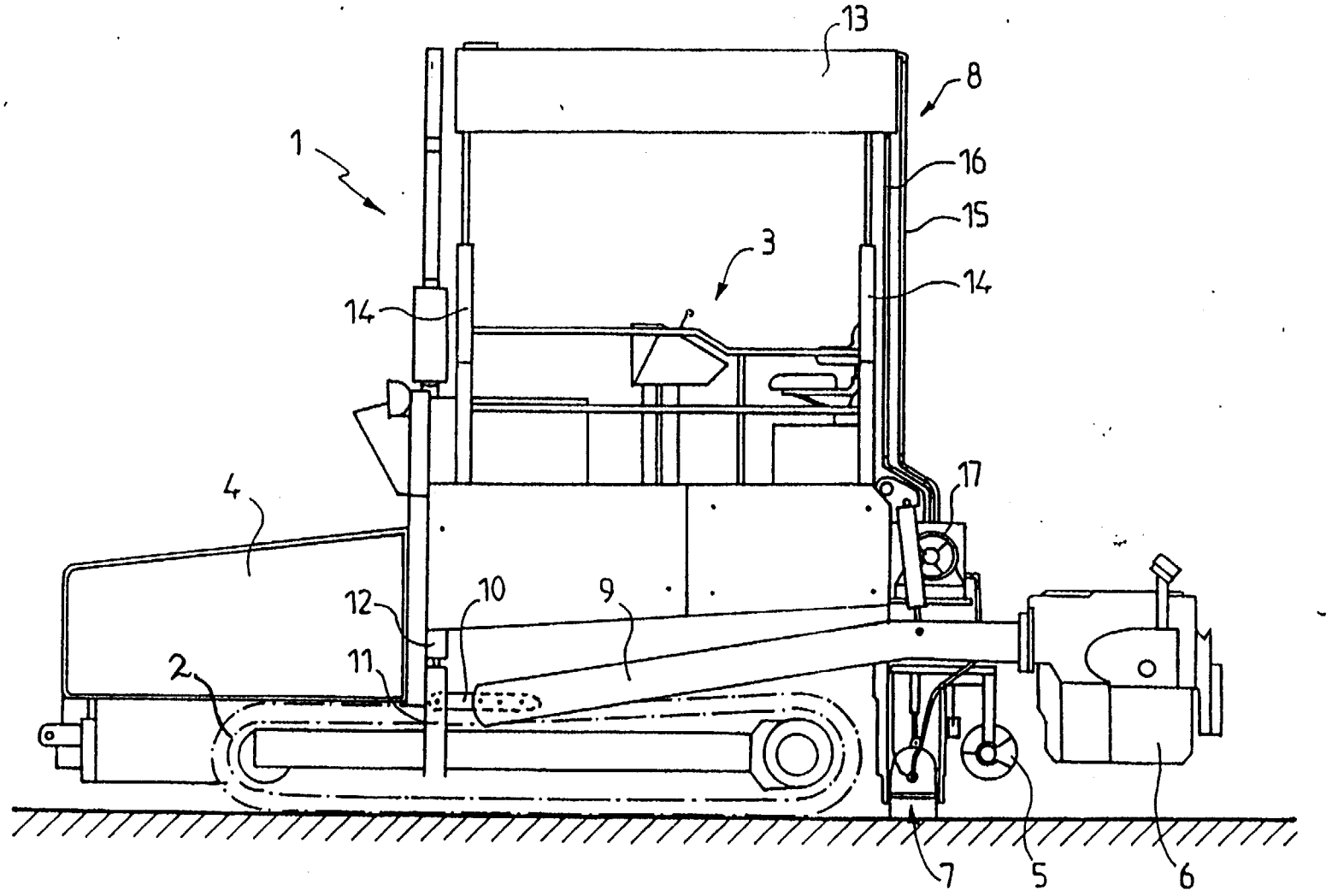

Referring more particularly to FIGS. 2 to 4, it can be seen that the binder-spreading device 7 comprises a spreading bar 18 which essentially consists of a chamber 19 containing inside it emulsion in nebulized form.

This chamber 19 is delimited by the walls of a main box 20 which is a box of U-shaped cross-section extending substantially over the entire width of the finisher 1 and the open part of which is opposite the highway C. The chamber 19 is furthermore also delimited laterally by the walls of two secondary boxes 21 and 22 which extend the main box 20 on each of its sides. The secondary boxes 21 and 22 therefore make it possible to make, if necessary, extensions to said main box 20. They are each associated with a hydraulic jack 23, the cylinder of which extends respectively over substantially half the width of the main box 20, and the movable rod 24 of which is connected to the secondary boxes 21 or 22 to which said jack is associated via a tie bar 25 which is fastened to them at their end furthest from the main box 20.

The box 20 is held on the frame of the finisher 1 via two jacks 26, the rods of which are articulated on the box 20 toward the two ends of the latter and which are mounted on each side of the finisher 1. These two jacks 26 serve as bearing and raising jacks for the spreading bar 18 with respect to the highway C. The box 20 is intended to permit the spreading of the emulsion or binder across the width of the finisher 1, the two secondary boxes 21 and 22 making it possible to create extensions to the left and to the right with respect to said main box 20, and to spread emulsion over widths greater than the width of the finisher 1. In all cases, the spreading takes place perpendicularly to the axis of displacement of the machine.

Each of the side end walls of the secondary boxes 21 and 22 is equipped with a pneumatic emulsion atomizer 27 to which is connected, on the one hand, a compressed-air inlet 28 and an inlet 29 serving for the supply of binder. These two atomizers 27 create, in the whole of the chamber 19, when they are supplied, a supersaturated atmosphere of nebulized emulsion. The main box 20 is furthermore associated, toward its mid part, with a duct 30 which is connected to a hot-air circuit and is intended for the warming of the whole chamber 19 upon start-up after the spreading device has been shut down. The box 20 is surrounded externally at its aperture, on each of its lengthwise sides, by a skirt 31 which extends in the working position of the spreading bar 18, from said aperture to the highway C. The walls of the boxes 21 and 22 are for their part surrounded internally at the aperture of the chamber 19 by skirts 32 which also extend from said aperture to the highway C in the working position of the spreading bar 18. The skirts 31 and 32 are supplemented with a low-pressure air curtain 33 which ensures the elimination of any leaks and surrounds the aperture of the chamber 19, the assembly making it possible to define the deposition surface for the nebulized emulsion in a leaktight manner on the highway C.

The device as a whole is further supplemented by a high- and low-pressure air distributor and by a set of control means.

The chamber 19 is associated with means which are intended to promote the deposition of the nebulized emulsion through its aperture onto the highway C. These repulsion means permit a homogeneous distribution of the nebulized emulsion over the highway C and prevent, for example, the emulsion from amalgamating in slabs on the walls of the chamber 19, which slabs, when they are detached under the effect of their weight, could cause irregularities in the deposited surface.

As has been shown more particularly in FIG. 3, the abovementioned means can, for example, consist of means enabling the walls of the chamber 19, in other words the walls of the box 20 and of the secondary boxes 21 and 22, to be charged positively, the emulsion used being a cationic emulsion, and the boxes 20, 21 and 22 being metal boxes, for example made from stainless steel. Under the effect of the electric repulsion, the particles of the nebulized emulsion, pushed away from the walls of the chamber, are thrown toward the ground, the potential of which is earth.

In another possible alternative, shown in FIG. 4, the inside of the walls of the box are coated with a material of the polytetrafluoroethylene type, which has a low, or no adhesion to the nebulized emulsion and which serves as a repulsion means. The supersaturation obtained in the box causes the emulsion to run down the walls of the boxes 20, 21 and 22, and then the skirts 31 and 32 ensure the smoothing and the distribution of the emulsion over the highway C.

The sole purpose of the reference symbols inserted after the technical features mentioned in the claims is to facilitate the comprehension of the latter and in no way limit their scope.

What is claimed is:

1. A device for spreading a fluid substance or the like, in particular a bonding emulsion for bituminous coated materials, over the surface of a road (C), comprising, on a movable machine (1), at least one spreading bar (18) along which the spreading is effected at least partially, said bar being associated with an emulsion-supply circuit, wherein a bar comprises at least one chamber (19) comprising at least one aperture on its part intended to be opposite the road (C), said chamber (19) being associated with supply and nebulization means (27, 28, 29) which make it possible to supply the inside of said chamber (19) with nebulized emulsion, and with means intended to promote the deposition of the nebulized emulsion on the road (C) through said aperture.

2. The device as claimed in claim 1, wherein the means intended to promote the deposition of the emulsion on the road (C) comprise a coating of the walls which define said chamber (19) with a material having a low, or substantially no adhesion to the bonding emulsion.

3. The device as claimed in claim 2, wherein a material constituting said coating is of the polytetrafluoroethylene type.

4. The device as claimed in claim 1, for the spreading of an ionic or electrically charged bonding emulsion, wherein said chamber (19) is insulated electrically from the mass of the movable machine (1), the walls of said chamber (19) being charged electrically with a polarity identical to that of the emulsion.

5. The device as claimed in claim 4, wherein the walls of said chamber are at least partially made from metal, in particular from non-oxidizing metal.

6. The device as claimed in claim 4, wherein the walls of the chamber (19) are positively charged, the emulsion being a cationic emulsion.

7. The device as claimed in claim 1, wherein the length of the chamber (19) can be adjusted.

8. The device as claimed in claim 7, wherein the chamber (19) comprises a main part (20) which is associated with means (21, 22, 23, 24, 25) enabling said main part to be extended laterally.

9. The device as claimed in claim 8, wherein the chamber (19) comprises a main part (20) extending substantially over a width of the movable machine (1) and associated at each of its ends with lateral-extension means (21, 22, 23, 24, 25).

10. The device as claimed in claim 1, wherein a chamber (19) is delimited, wholly or partly, by the walls of a box which is equipped with an aperture on its part opposite the road.

11. The device as claimed in claim 9, wherein the main part of the chamber (19) is delimited by a central box (20) which extends substantially over a width of the movable machine (1) and which is associated at each of its ends with a lateral box (21, 22) connected leaktightly by fitting together with said central box, the length of the relative fitting-together of the central box and of a lateral box being adjustable.

12. The device as claimed in claim 1, wherein the length of the chamber (19) is adjusted via hydraulic jacks (23, 24).

13. The device as claimed in claim 1, wherein the supply and nebulization means comprise a pneumatic atomizer (27) associated with an emulsion inlet (29) and a pressurized-gas inlet (28).

14. The device as claimed in claim 13, wherein the pressurized gas is compressed air.

15. The device as claimed in claim 1, wherein supply and nebulization means (27, 28, 29) are distributed toward each of the ends of the chamber (19) and/or toward its mid part.

16. The device as claimed in claim 1, wherein the aperture of the chamber is surrounded at least partially by flexible skirts (31, 32) which extend, in the operating position of the bar (18), from said aperture substantially to the surface of the road (C).

17. The device as claimed in claim 1, wherein the aperture of the chamber (19) is surrounded at least partially by a curtain or curtains (33) of pulsed air.

18. The device as claimed in claim 1, wherein the chamber (19) is associated with a nozzle (30) for supplying gas or hot air.

19. The device as claimed in claim 1, wherein the bar (18) is associated with means (26) mounted on the movable machine (1) and enabling said bar (18) to be placed in the operating position or to be raised with respect to the road (C).

20. The device as claimed in claim 19, wherein said means for placing in the operating position or for raising are hydraulic jacks (26).

21. A highway-construction machine of the finisher type, comprising, on a frame mounted on displacement means (2), means (5) for spreading bituminous coated materials and means (4) for supplying said spreading means (5), wherein it comprises a device (7) for spreading a bonding emulsion for said coated materials over the surface of a road (C) as claimed in claim 1.

22. The machine as claimed in claim 21, wherein the device (7) for spreading a bonding emulsion is arranged at the rear of the frame with respect to the direction of displacement of the machine during the spreading of the coated materials.

23. The machine as claimed in claim 22, wherein the device (7) for spreading a bonding emulsion is arranged between the displacement means (2) of said machine and the means (5) for spreading bituminous coated materials.

24. The machine as claimed in claim 23, wherein the device (7) for spreading a bonding emulsion is arranged beneath the part of the supply means which is situated at the rear of the frame, with respect to the direction of displacement of the machine during spreading of the coated materials.

25. The machine as claimed in claim 24, in which the supply means comprise a supply belt which enables the materials to be conveyed from a zone (4) toward the front part of the machine to a zone (5) toward its rear part, wherein said supply belt is substantially raised and/or inclined at its rear part just above the means (7) for spreading a bonding emulsion.

26. The machine as claimed in claim 21, comprising a control cabin (3), wherein it comprises an emulsion tank (13) mounted on the control cabin (3).

27. The machine as claimed in claim 26, wherein an interchangeable tank is mounted on height-adjustable hydraulic jacks (14).

28. The machine as claimed in claim 21, wherein it comprises a heat-insulated emulsion tank.

29. The machine as claimed in claim 21, wherein it comprises an emulsion-metering unit which comprises a metering pump supplying the nebulization means.

30. The machine as claimed in claim 21, wherein it comprises a set of control means which make it possible for the flow rate and the stopping of the binder supply to be made dependent upon the displacement and the speed of the machine.

31. The machine as claimed in claim 21, wherein the spreading device with which it is associated is capable of being disconnected rapidly from the frame of the machine.

* * * * *

UNITED STATES PATENT AND TRADEMARK OFFICE

CERTIFICATE OF CORRECTION

PATENT NO. : 5,178,486

DATED : January 12, 1993

INVENTOR(S) : M. Perrin, et al

It is certified that error appears in the above-indentified patent and that said Letters Patent is hereby corrected as shown below:

At the Abstract, line 1, change "A device" to ---Device---.

At the Abstract, line 2, change "coated" to ---coating---.

At the Abstract, line 3, change "(C), comprising" to ---, including---.

At the Abstract, line 4, delete "(1)".

At the Abstract, line 4, delete "(18)".

At the Abstract, lines 5-6, change "effected at least partially. said bar being" to ---at least partially effected. The at least one spreading bar is---.

At the Abstract, line 7, change "a" to ---the---.

At the Abstract, line 7, delete "(19)".

At the Abstract, line 9, change "(C), said chamber (19)" to ---, the chamber---.

At the Abstract, line 10, change "means (27,28,29)" to ---mechanisms---.

At the Abstract, lines 11-12, change "said chamber (19) with" to ---the chamber with the---.

At the Abstract, line 14, delete "(C)".

At Figure 1, insert "2" with a line connecting the number to the caterpillar tracks indicated by the parallel set of broken lines in the center of the lower third of the hopper 4.

At column 1, line 31, change "coated" to ---coating---.

A column 1, line 35, change "said" to ---the---.

At column 1, line 52, change "said" to ---the--- (both occurrences).

At column 1, line 56, change "said" to ---the---.

At column 2, line 14, change "said" to ---the---.

At column 2, line 16, change "said" to ---the--- (both occurrences).

At column 2, line 20, change "said" to ---the---.

UNITED STATES PATENT AND TRADEMARK OFFICE

CERTIFICATE OF CORRECTION

PATENT NO. : 5,178,486

DATED : January 12, 1993

INVENTOR(S) : M. Perrin, et al

It is certified that error appears in the above-indentified patent and that said Letters Patent is hereby corrected as shown below:

At column 2, line 28, change "said" to ---the---.
At column 2, line 31, change "said" to ---the---.
At column 2, line 33, change "said" to ---the---.
At column 2, line 36, change "said" to ---the---.
At column 2, line 39, change "said" to ---the---.
At column 2, line 42, change "said" to ---the---.
At column 2, line 45, change "said" to ---the---.
At column 2, line 47, change "said" to ---the---.
At column 2, line 49, change "said" to ---the---.
At column 2, line 56, change "said" to ---the---.
At column 2, line 67, change "said" to ---the---.
At column 3, lines 10-11, change "surrounded at least partially" to ---at least partially surrounded---.
At column 3, line 12, change "said" to ---the---.
At column 3, line 18, change "said" to ---the---.
At column 3, line 20, change "Said" to ---The---.
At column 3, line 25, change "coated" to ---coating---.
At column 3, line 26, change "said" to ---the---.
At column 3, line 27, change "said coated" to ---the coating---.
At column 3, line 32, change "coated" to ---coating---.
At column 3, line 34, change "said" to ---the---.
At column 3, line 35, change "coated" to ---coating---.
At column 3, line 44, change "said" to ---the---.
At column 4, line 8, change "A-A" to ---III-III---.
At column 4, line 20, change "coated" to ---coating---.
At column 4, line 21, change "said" to ---the---.

UNITED STATES PATENT AND TRADEMARK OFFICE

CERTIFICATE OF CORRECTION

PATENT NO. : 5,178,486

DATED : January 12, 1993

INVENTOR(S) : M. Perrin et al

It is certified that error appears in the above-indentified patent and that said Letters Patent is hereby corrected as shown below:

At column 4, line 26, change "coated" to ---coating---.

At column 4, line 37, change "coated" to ---coating---.

At column 4, line 43, change "said" to ---the---.

At column 4, line 58, delete "said".

At column 5, line 20, change "said" to ---the---.

At column 5, line 33, change "said" to ---the---.

At column 5, line 51, change "said" to ---the---.

At column 5, line 54, change "said" to ---the---.

At column 6, line 33 (claim 1, line 2), change "coated" to ---coating-

At column 6, line 34 (claim 1, line 3), delete "(C)".

At column 6, line 35 (claim 1, line 4), delete "(1)".

At column 6, line 35 (claim 1, line 4), delete "(18)".

At column 6, line 37 (claim 1, line 6), insert "at least one spreading" before ---bar---.

At column 6, line 38 (claim 1, line 7), change "a bar" to ---at least one of said at least one spreading bar---.

At column 6, line 38 (claim 1, line 7), delete "(19)".

At column 6, line 40 (claim 1, line 9), change "(C), said chamber (19)" to ---, said at least one chamber---.

At column 6, lines 41-43 (claim 1, lines 10-12), change "(27,28,29) which make it possible to supply the inside of said chamber (19)" to --- for supplying the inside of said at least one chamber---.

At column 6, line 44 (claim 1, line 13), change "intended to promote the" to ---for promoting---.

At column 6, line 45 (claim 1, line 14), change "(C) through said" to ---through said at least one---.

At column 6, line 46 (claim 2, line 1), change "the" to ---said---.

At column 6, line 47 (claim 2, line 2), change "intended to promote the" to ---for promoting---.

UNITED STATES PATENT AND TRADEMARK OFFICE

CERTIFICATE OF CORRECTION

PATENT NO. : 5,178,486

DATED : January 12, 1993

INVENTOR(S) : M. Perrin et al.

It is certified that error appears in the above-indentified patent and that said Letters Patent is hereby corrected as shown below:

At column 6, lines 47-48 (claim 2, lines 2-3), change "the emulsion" to ---the nebulized emulsion---.

At column 6, line 48 (claim 2, line 3), change "(C) comprise a coating of" to ---comprise a coating on---.

At column 6, line 49 (claim 2, line 4), change "chamber (19) with" to ---at least one chamber of---.

At column 6, line 57 (claim 4, line 3), change "chamber (19)" to ---at least one chamber---.

At column 6, line 58 (claim 4, line 4), change "machine (1)," to ---machine,---.

At column 6, line 59 (claim 4, line 5), change "chamber (19)" to ---at least one chamber---.

At column 6, line 62 (claim 5, line 2), change "said chamber" to ---said at least one chamber---.

At column 6, line 65 (claim 6, line 2), change "the chamber (19)" to ---said at least one chamber---.

At column 6, line 68 (claim 7, line 2), change "the chamber (19) can be adjusted" to ---said at least one chamber is adjustable---.

At column 7, lines 1-2 (claim 8, lines 1-2), change "the chamber (19) comprises a main part (20)" to ---said at least one chamber comprises a main part---.

At column 7, line 3 (claim 8, line 3), delete "(21.22.23.24.25)".

At column 7, line 4 (claim 8, line 4), change "extended laterally" to ---laterally extended---.

At column 7, lines 5-6 (claim 9, lines 1-2), change "the chamber (19) comprises a main part (20)" to ---said at least one chamber comprises a main part---.

At column 7, line 7 (claim 9, line 3), delete "(1)".

At column 7, line 9 (claim 9, line 5), change "means (21,22.23,24.25)" to ---elements---.

UNITED STATES PATENT AND TRADEMARK OFFICE

CERTIFICATE OF CORRECTION

PATENT NO. : 5,178,486

DATED : January 12, 1993

INVENTOR(S) : M. Perrin et al.

It is certified that error appears in the above-indentified patent and that said Letters Patent is hereby corrected as shown below:

At column 7, lines 10-11 (claim 10, lines 1-2), change "a chamber (19)" to ---said at least one chamber---.

At column 7, line 15 (claim 11, line 2), change "the chamber (19)" to ---said at least one chamber---.

At column 7, line 16 (claim 11, line 3), delete "(20)".

At column 7, line 17 (claim 11. line 4). delete "(1)".

At column 7, line 18 (claim 11, line 5), delete "(21,22)".

At column 7, line 22 (claim 12, line 1), change "1" to ---7---.

At column 7, line 23 (claim 12, line 2), change "the chamber (19)" to ---said at least one chamber---.

At column 7, line 24 (claim 12, line 3), delete "(23,24)".

At column 7, line 27 (claim 13, line 3), delete "(27)".

At column 7, line 27 (claim 13, line 3), delete "(29)".

At column 7, line 28 (claim 13, line 4), delete "(28)".

At column 7, line 31 (claim 15, line 1), before "supply" insert ---said means for---.

At column 7, line 32 (claim 15, line 2), delete "(27,28,29)".

At column 7, line 33 (claim 15, line 3), change "chamber (19)" to ---at least one chamber---.

At column 7, lines 35-36 (claim 16, lines 1-2), change "the aperture of the" to ---said at least one aperture of said at least one---.

At column 7, line 37 (claim 16, line 3), delete "(31,32)".

At column 7, line 38 (claim 16, line 4), change "(18). from said aperture" to ---, from said at least one aperture---.

At column 7. line 39 (claim 16. line 5), delete "(C)".

At column 7. lines 40-41 (claim 17, lines 1-2), change "the aperture of the chamber (19)" to ---said at least one aperture of said at least one chamber---.

UNITED STATES PATENT AND TRADEMARK OFFICE

CERTIFICATE OF CORRECTION

PATENT NO. : 5,178,486

DATED : January 12, 1993

INVENTOR(S) : M. Perrin et al.

It is certified that error appears in the above-indentified patent and that said Letters Patent is hereby corrected as shown below:

At column 7, line 42 (claim 17, line 3), change "a curtain or curtains (33)" to ---at least one curtain---.

At column 7, lines 43-44 (claim 18, lines 1-2), change "the chamber (19)" to --- said at least one chamber---.

At column 7, line 44 (claim 18, line 2), delete "(30)".

At column 7, line 47 (claim 19, line 2), delete "(18)" and "(26)".

At column 7, line 48 (claim 19, line 3), change "(1) and" to ---for---.

At column 7. line 48 (claim 19, line 3), delete "(18)".

At column 7, line 50 (claim 19, line 5), delete "(C)".

At column 8, line 3 (claim 20, line 3), delete "(26)".

At column 8, lines 5-6 (claim 21, lines 2-3), change "displacement means (2), means (5)" to ---means for displacement, means---.

At column 8, line 6 (claim 21, line 3), change "coated" to ---coating---.

At column 8, lines 7-8 (claim 21, lines 4-5), change "means (4) for supplying said spreading means (5)," to ---means for supplying said means for spreading,---.

At column 8, line 8 (claim 21, line 5), change "wherein it comprises a device (7)" to ---and further comprising a device---.

At column 8, line 9 (claim 21, line 6), change "coated" to ---coating---.

At column 8, line 10 (claim 21, line 7), delete "(C)".

At column 8. line 12 (claim 22. line 2). delete "(7)".

At column 8. line 15 (claim 22, line 5), change "coated materials" to ---coating material---.

At column 8. line 17 (claim 23, line 2). delete "(7)".

At column 8. lines 18-19 (claim 23. lines 3-4), change "displacement means (2) of said machine and the means (5)" to ---means for displacement and the means---.

UNITED STATES PATENT AND TRADEMARK OFFICE

CERTIFICATE OF CORRECTION

PATENT NO. : 5,178,486

DATED : January 12, 1993

INVENTOR(S) : M. Perrin et al.

It is certified that error appears in the above-indentified patent and that said Letters Patent is hereby corrected as shown below:

At column 8, line 19 (claim 23, line 4), change "coated" to ---coating---.

At column 8, line 22 (claim 24, line 2), delete "(7)".

At column 8, line 26 (claim 25, line 2), change "coated" to ---coating---.

At column 8, line 28 (claim 25, line 2), change "supply means" to ---means for supply---.

At column 8, line 29 (claim 25, line 3), delete "(4)".

At column 8, line 30 (claim 25, line 4), delete "(5)".

At column 8, line 32 (claim 25, line 6), delete "(7)".

At column 8, lines 35-36 (claim 26, lines 2-3), change "(3), wherein it comprises an emulsion tank (13)" to ---, and said device for spreading a bonding emulsion comprises an emulsion tank---.

At column 8, line 36 (claim 26, line 3), delete "(3)".

At column 8, line 37 (claim 27, line 1), after "wherein" insert ---said emulsion tank comprises---.

At column 8, line 38 (claim 27, line 2), delete "is".

At column 8, line 39 (claim 27, line 3), delete "(14)".

At column 8, line 40 (claim 28, line 1), change "it" to ---said device for spreading a bonding emulsion---.

At column 8, line 42 (claim 29, line 1), change "it" to ---said device for spreading a bonding emulsion---.

UNITED STATES PATENT AND TRADEMARK OFFICE

CERTIFICATE OF CORRECTION

PATENT NO. : 5,178,486

DATED : January 12, 1993

INVENTOR(S) : M. Perrin et al.

It is certified that error appears in the above-indentified patent and that said Letters Patent is hereby corrected as shown below:

At column 8, line 44 (claim 29, line 3), change "the" to ---said---.

At column 8, line 45 (claim 30, line 1), change "it" to ---said device for supplying a bonding emulsion---.

At column 8, lines 46-47 (claim 30, lines 2-3), change "which make it possible for the" to ---for controlling---.

At column 8, line 47 (claim 30, line 3), change "the stopping of the binder" to ---stopping of binder---.

At column 8, line 48 (claim 30, line 4), delete "to be made".

At column 8, line 48 (claim 30, line 4), delete "the" (both occurrences).

At column 8, line 50 (claim 31, line 1), change "the" to ---said at least one---.

At column 8, line 51 (claim 31, line 2), change "device with which it is associated" to ---bar---.

Figure 1 should be deleted to be replaced with figure 1 as shown on the attached sheet.

Signed and Sealed this

Eighth Day of November, 1994

*Attest:*

Bruce Lehman

BRUCE LEHMAN

*Attesting Officer*

*Commissioner of Patents and Trademarks*